US005718167A

United States Patent [19]

Renz et al.

[11] Patent Number: 5,718,167

[45] Date of Patent: Feb. 17, 1998

[54] OBSTRUCTION REMOVAL APPARATUS FOR STRAPPING MACHINES

[75] Inventors: Mark Renz, Arlington Hts.; James Haberstroh, Vernon Hills, both of Ill.

[73] Assignee: Illinois Tool Works Inc., Glenview, Ill.

[21] Appl. No.: 573,205

[22] Filed: Dec. 15, 1995

[51] Int. Cl.[6] ..... B65B 13/18

[52] U.S. Cl. ..... 100/29; 53/589; 100/33 PB

[58] Field of Search ..... 100/8, 26, 29, 100/32, 33 PB; 53/589

[56] References Cited

U.S. PATENT DOCUMENTS

| | | | |
|---|---|---|---|
| 3,913,472 | 10/1975 | Buck | 100/33 PB |
| 4,164,176 | 8/1979 | Brouse et al. | 100/26 |
| 4,739,700 | 4/1988 | Brouse et al. | 100/29 |
| 4,850,179 | 7/1989 | Takami | 100/33 PB |

*Primary Examiner*—Stephen F. Gerrity
*Attorney, Agent, or Firm*—Dvorak & Orum

[57] ABSTRACT

A strapping machine apparatus manipulated through a single actuating lever action, allows the machine strapping chute to be fully opened and exposed for rapid obstruction removal, and/or servicing.

6 Claims, 5 Drawing Sheets

OBSTRUCTION REMOVAL APPARATUS FOR STRAPPING MACHINES

CROSS REFERENCE TO RELATED APPLICATIONS

This invention is related to the following co-pending applications, all commonly assigned to Illinois Tool Works, Inc., Glenview, Ill.:

Inertial Strap Tensioning Apparatus and Method for Strapping Machine Ser. No. 8/573,432, filed on Nov. 15, 1995;

Two-Stage Gripping Apparatus and Method for Strapping Machine; Ser. No. 8/573,459, filed on Dec. 15, 1995;

Strap Path Access Apparatus and Method for Strapping Machine Ser. No. 8/573,457, filed on Dec. 15, 1995; and Strap Severing and Ejecting Apparatus and Method for Strapping Machine Ser. No. 8/573,326, filed on Dec. 15, 1995.

BACKGROUND OF THE INVENTION

1. Field of the Invention

The present invention relates to strapping machines for positioning and securing a binding strap around object(s), and more specifically to an apparatus and method for opening and exposing critical machine components in order to facilitate inspection and repair in a safer, yet more timely manner.

2. Description of the Related Art

A problem common to all prior art strapping machines concerns the situation where the internals of the machine must be exposed in order to perform some sort of repair or maintenance, or clearing loose or jammed strap from the sealer mechanism.

Typically, there are several concerns which must be addressed before the machine internals can be exposed. First, the strap itself must be completely cleared from the operating components of the machine or else it most likely interferes with the desired inspection/maintenance.

Secondly, the sealer mechanism, being hot enough to melt the strap's ends together, is usually advanced to a servicing mode by indexing through a partial cycle. This is usually achieved by electronically driving the mechanism, which usually involves complicated and difficult procedures.

Moreover, in addressing the above-mentioned concerns, it is most typical for prior art machines to require manual removal of one or more operating guards in order to initially expose the key components. The guards are usually attached by some sort of anchoring means, i.e., clips, screws, bolts, which have a natural tendency to get lost or delay the removal of the guarding. Even then, after the guarding is removed, a separate series of functions are required in order to cut and remove the strap existing in the machine, and then to swing pinch rolls, cutters, etc., away from their co-acting components. All of these secondary functions require expenditure of time, which becomes costly in terms of strapping machine down-time and lower production levels. Furthermore, introduction of worker safety issues presents itself whenever lock-out of machine components becomes necessary in order to reach critical areas.

In light of the above-mentioned concerns, attempts have been made to improve the described situation. For example, a certain manufacturer has introduced an apparatus which partially avoids a complete reliance on manual machine manipulation by introducing two lever arm components as a means for opening and clearing.

One of the lever arms is arranged such that mechanical manipulation of said arm causes the strap chute to be driven open, thereby eliminating the need for a service technician to perform several manual steps in order to accomplish the same results. A second lever arm is manipulated to actuate the strap cutter. However, this arrangement still requires manual manipulation of the levers to open the machine, which is problematic if not performed in the right sequence. Further, the anvil or separator components do not open while in the service mode. This restricts access to an area critical for service in order to remove the loose strapping fragments and dust which accumulate there. Moreover, the prior art devices are sliding motion designs which require timely lubrication, or else they can become inoperative. Furthermore, a concern from a safety point of view is present since prior arrangements do not lock out these components.

SUMMARY OF THE INVENTION

It is therefore a primary object of the present invention to provide a strapping machine, which will heretofor be generally described as an obstruction removal apparatus, that facilitates the opening and exposure of key machine components in one relatively convenient motion or manipulation.

It is another object of the invention to provide a pivoting apparatus that eliminates the use of screws, bolts, or clips to secure machine guarding components as well as the problems associated with removing or reinstalling such devices, as well as the need to lubricate.

It is another object of the present invention to provide an apparatus which can essentially separate key operating components from each other, thereby opening the sealer mechanism components for complete access to the strap path area in a single step lever action.

It is a final object to provide an over-center spring design which provides two distinct lever positions; operating and servicing.

The objects of the present invention are accomplished by providing an apparatus which performs all of the above desires by manipulation of a single actuating lever. Downward manipulation of the lever causes a series of simultaneous events to occur within the strapping machine so that the strapping chute can be opened, the cutting anvil and strap separator removed and locked out in the open position, and the cutter advanced to sever the strap so that the strapping path becomes entirely exposed. In this way, a lone procedure allows a service technician to immediately begin his internal inspection of the machine for obstructions, or to begin normal repair and replacement of key components and have the components locked open so as not to create safety concerns through inadvertent cycling during cleaning or inspection.

These and other inherent objects of the invention will be met by the apparatus and method more fully described below.

BRIEF DESCRIPTION OF THE DRAWINGS

The present invention will be described in greater detail with use of the following drawings wherein.

DESCRIPTION OF THE PREFERRED EMBODIMENT

The obstruction removal apparatus of the present invention will now be described, but a basic overview of what the invention is attempting to operationally accomplish is necessary before providing a detailed description of the components.

Figure 5:
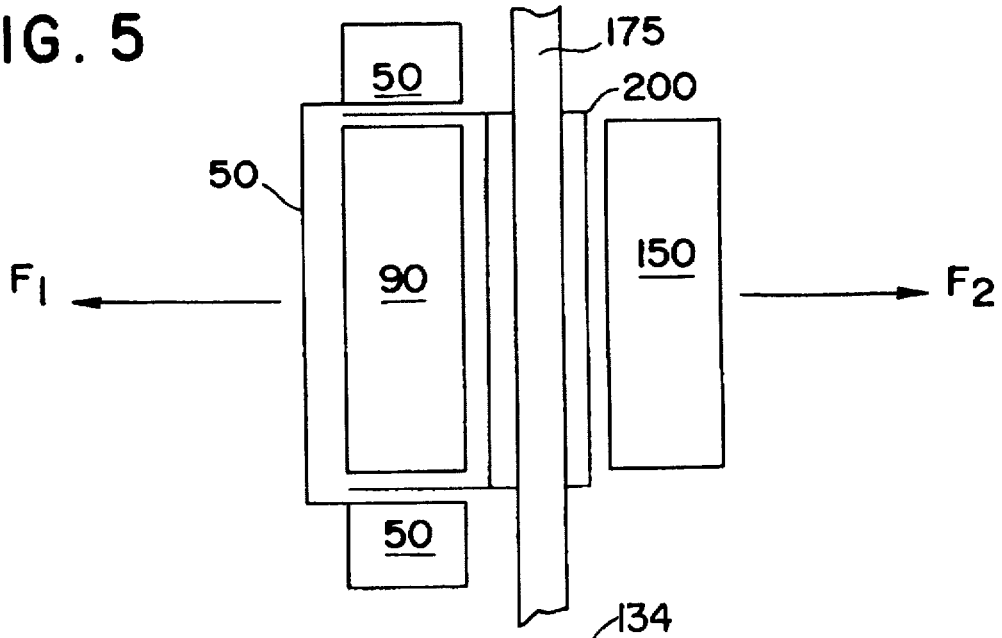
FIG. 5 is a schematic of how the strapping machine pivots open.

Turning attention to FIG. 5, this schematic top view illustrates that a strapping chute 175 is provided above a strapping machine framework 200. The framework has various components achored to it which will generally be referred to when necessary within this disclosure, but will not be discussed with any detail, since they are not part of the actual invention presented herein. Nevertheless, it should be understood that the strap chute 175 receives the traveling strap or strapping strip, which when in this area of the machine, will or can be severed in order to join two strip ends about a package, the joining process being the well-known hot gluing or hot sealing method.

Occasionally during the operation of the strapping machine, several conditions arise wherein access to the internals needs to be addressed. For example, problems can arise with the glue sealing mechanism anvil or periodically, the cutting knife needs replacement, or plastic chips from previously severed strip sections will build-up and create strip movement problems. For whatever reason, the present invention provides a means to quickly open the machine for inspection/repair through the manipulation of a single lever actuating assembly. Although the details of the assembly will be described later, suffice it to say that when the lever arm of the assembly (See FIG. 1, reference character 10) is pulled downwardly, the simultaneous opening of the major machine components that are disposed on each side of the strap chute are opened. By that it is meant that FIG. 5 shows that downward lever movement causes a simultaneous application of outwardly directed forces wherein the strap chute support bracket 50 and the anvil member 90 on the outboard side of chute 175, are pulled in the direction of $F_1$ while on the inboard side, the strap separator 158 is pulled in the direction of $F_2$. The frame 200 is stationary and is not affected. The components 50 and 90 move in unison with respect to each other and with strap separator 158, although as it will become clearer later, the strap separator is pivotably connected to the frame (not shown here), while the anvil member and chute support bracket are pivotably connected to each other. Thus, it should generally be understood at this point that the lever arm 10 (FIG. 1) is capable of operating upon the strap separator and the support bracket and the anvil members, all in simultaneous fashion.

Figure 1:
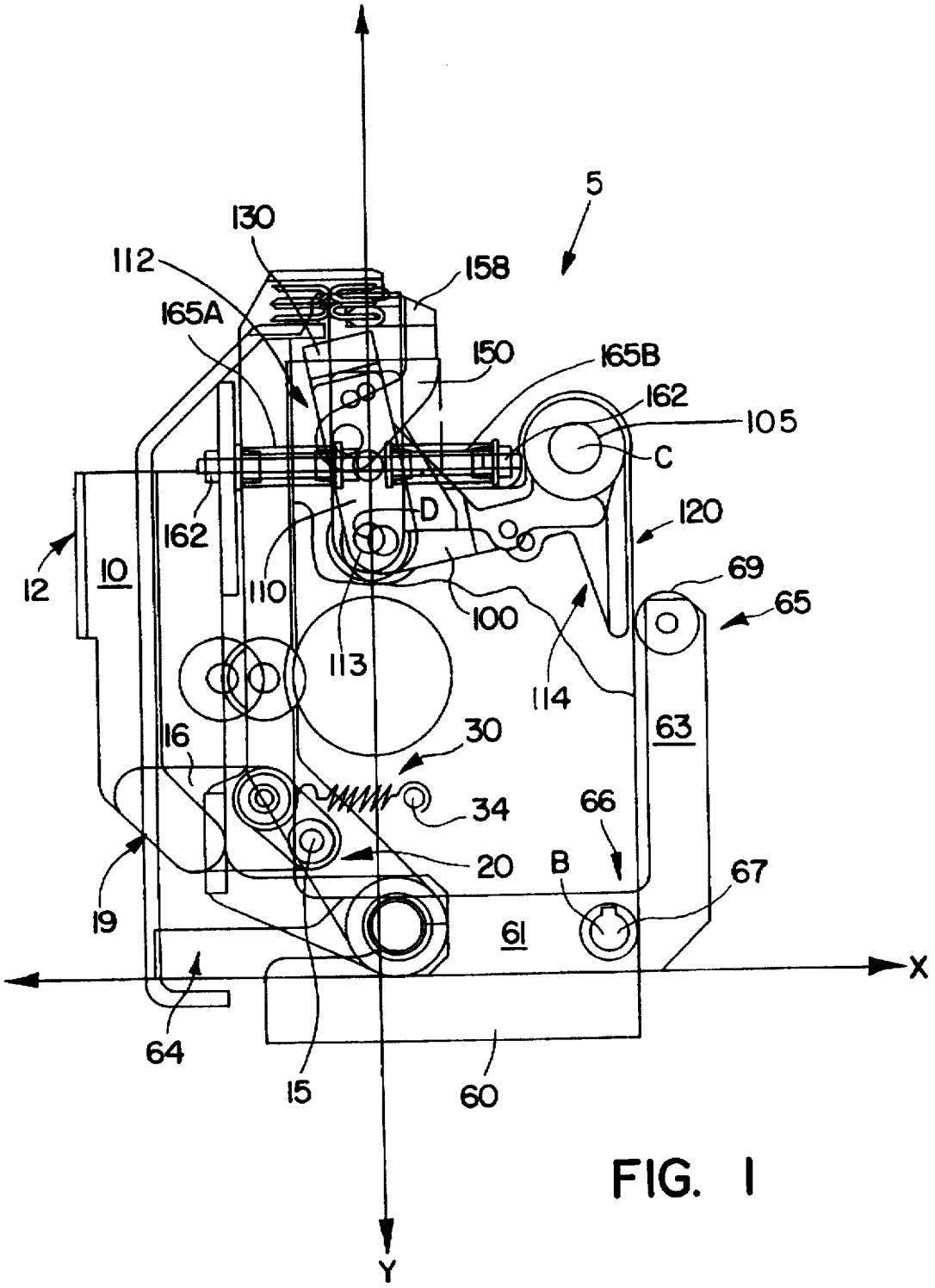
FIG. 1 is an end schematic view of the apparatus of the present invention in the normal, closed, and operating position.
Figure 2:
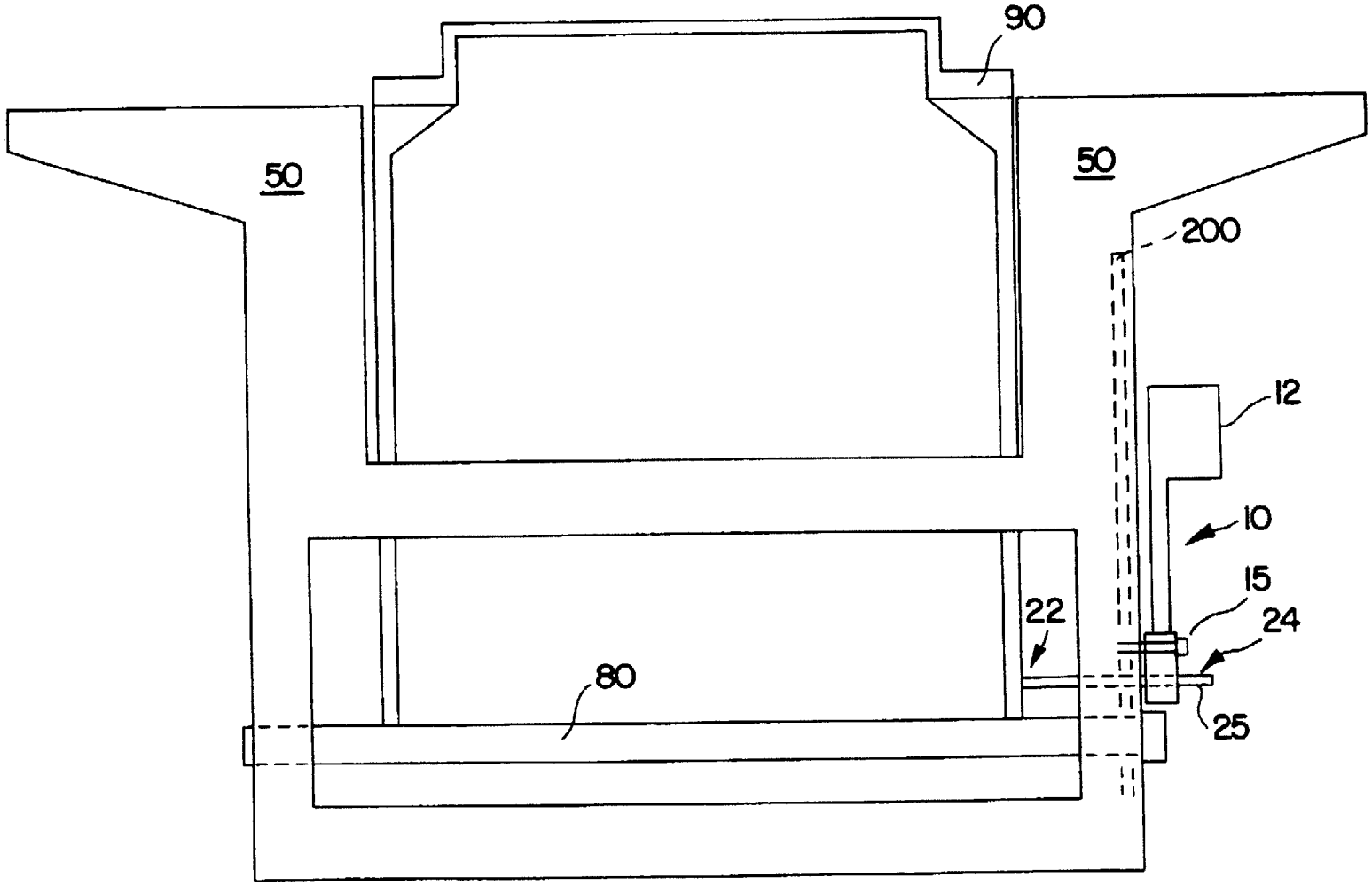
FIG. 2 is a front view of the present invention.

Turning attention now to FIGS. 1 and 2, the lever actuating assembly of the invention will now be described in greater detail.

Figure 3:
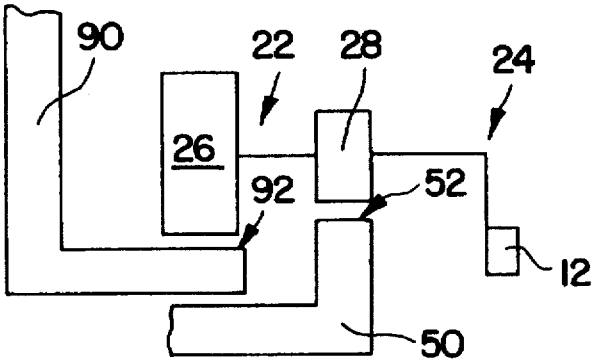
FIG. 3 is a schematic view showing the actuating lever relative to the anvil and support bracket.

The assembly is comprised of an actuating lever 10 having a handle 12 at its first end, while its second end 14 is attached by conventional means to a plate 16. Plate 16 has a generally parallelogrammed configuration, having an outside corner surface 17 and a side surface 19. The internal corner 20 is pivotably pinned to frame 200 by pin 15, thereby holding plate 16 and lever 10 along the side of obstruction apparatus 5. A shaft 25 projects normal to plate 16, having a first end 22 and a second end 24. The schematic sketch of FIG. 3 best shows the significance of shaft 25 in relation to anvil member 90 and strap chute support bracket 50 wherein it is seen that second end 24 is provided with a roller bearing 26 for making rolling contact against the internal surface 92 on anvil 90. A second roller bearing 28 is located intermediate the shaft ends so as to be in rolling contact against the edge surface 52 of support bracket 50. When handle 12 is downwardly pulled, it should be clear from considering FIGS. 2 and 3, that each bearing will contact their respective mating surface 92, 52. Simultaneously, the actuating assembly also includes a biasing spring 30 which has one end connected around catch 34, and the other end about second end 24 of shaft 25.

As FIG. 2 shows, it is also important to understand that anvil member 90 and support bracket 50 are tied together by the main axle 80, which means that when the force $F_1$ (FIG. 5) is effectively provided through manipulation of actuating lever 10, both members 50 and 90 will outwardly rotate about main axle 80, in unison.

Figure 4:
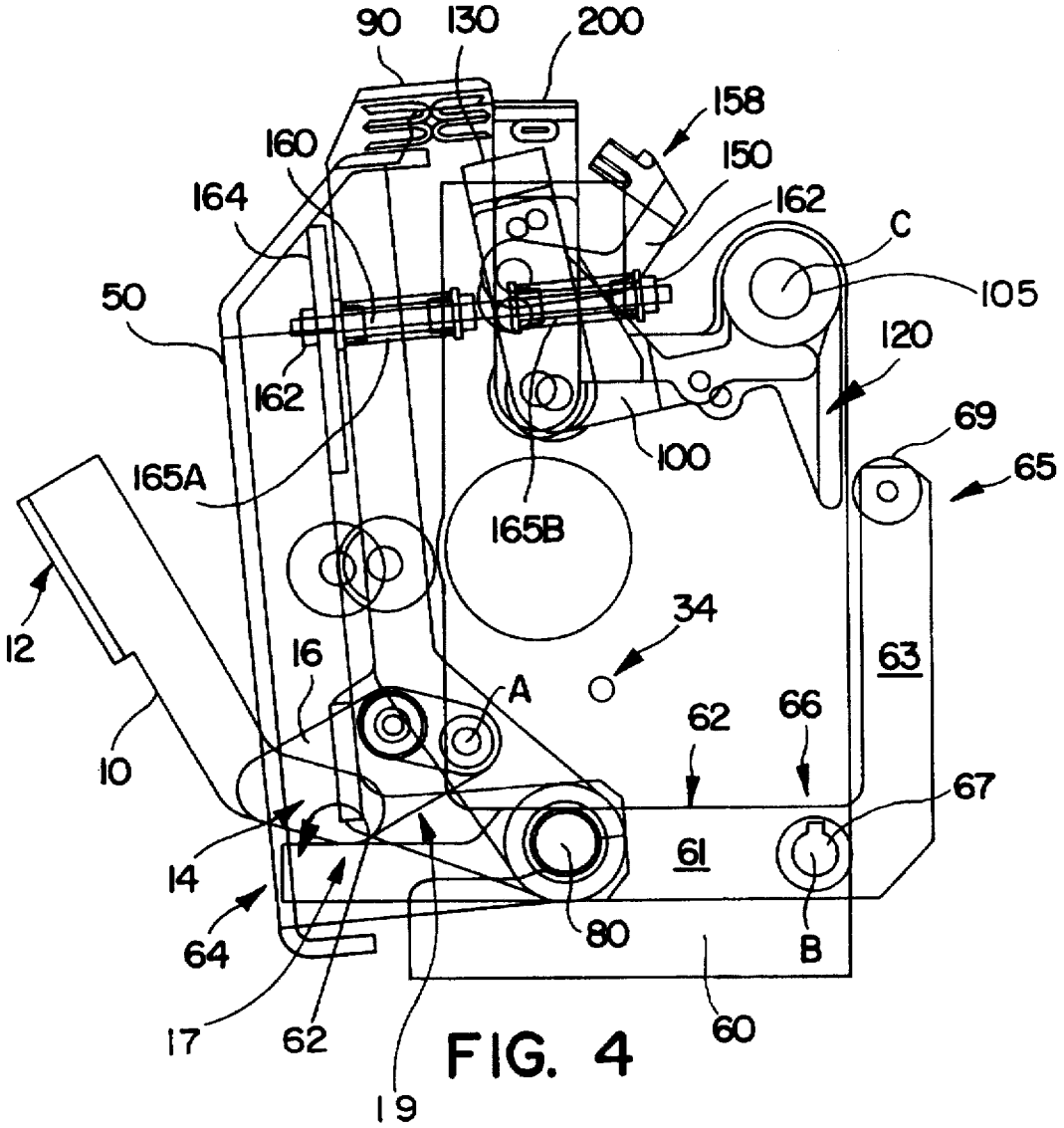
FIG. 4 is an end view of the apparatus of FIG. 1 wherein the actuating lever is initially manipulated into the first detent position.

Turning attention now to FIG. 4, it is seen that lever 10 is in a downwardly depressed position, herein considered a first detent position.

The first detent position is characterized by the outer corner surface 17 of plate 16 being in contact against the top surface 62 on the outboard end 64 of cut-off lever 60. Cut-off lever 60 is schematically shown in FIG. 4 to include a horizontal portion 61 and a vertical portion 63, forming a generally L'-shaped member. The inboard end 66 is pivoted at B to a rear axle 67 that extends between the frame of the apparatus. The vertical portion 63 has a top end 65 accepting a roller bearing 69. Comparing FIG. 1 to FIG. 4, it is seen that bearing 69 makes contact against platen surface 120 when handle 12 is pulled downwardly. During the downward handle movement, surface 17 pushes down on surface 62, causing cut-off lever 60 to rotate counterclockwise around pivot point B. Likewise, roller bearing 69 moves in the same direction, contacting platen surface 120. As should be understood from again referring to FIG. 5, the force $F_1$ is actually the result of cut-off lever 60 having its vertical portion bearing 69 pushing platen surface 120 towards the strap chute 175.

FIG. 4 also illustrates that actuation plate 100 is comprised of a base portion 110 that has a top end 112 and a base end 114, the platen 120 projecting from base 114. A pin 105 creates a rotation point C for the actuation plate to rotate about when bearing 69 contacts and pushes against platen surface 120.

Top end of base portion 110 includes a pinned strap separator carrier 150 that is pivotable about D due to pin 113. The top end 112 of base portion 110 also includes a cutter 130 connected by conventional means.

Figure 6:
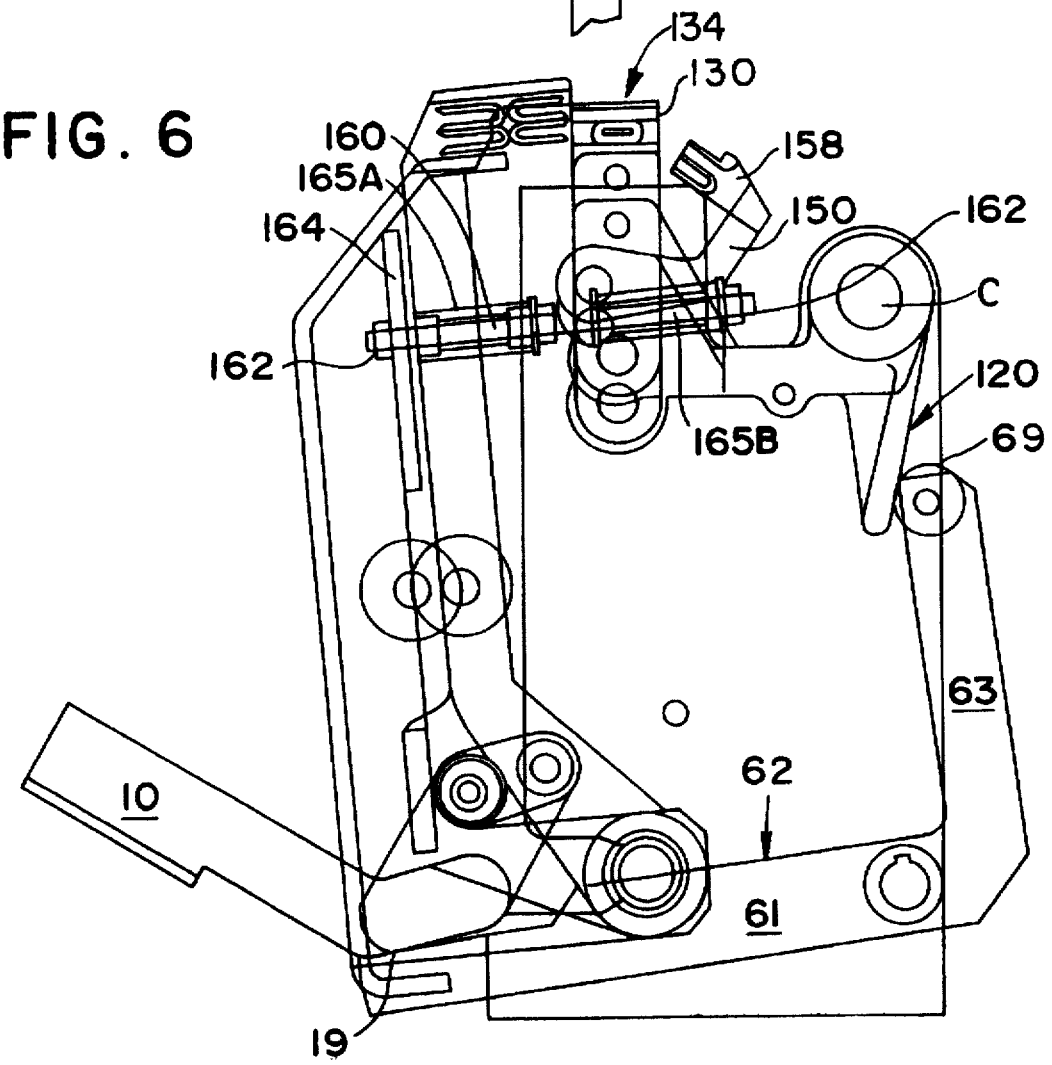
FIG. 6 is an end view of the apparatus of FIG. 4 wherein the lever is fully displaced or second detent position and the machine is completely locked open.
Figure 7:
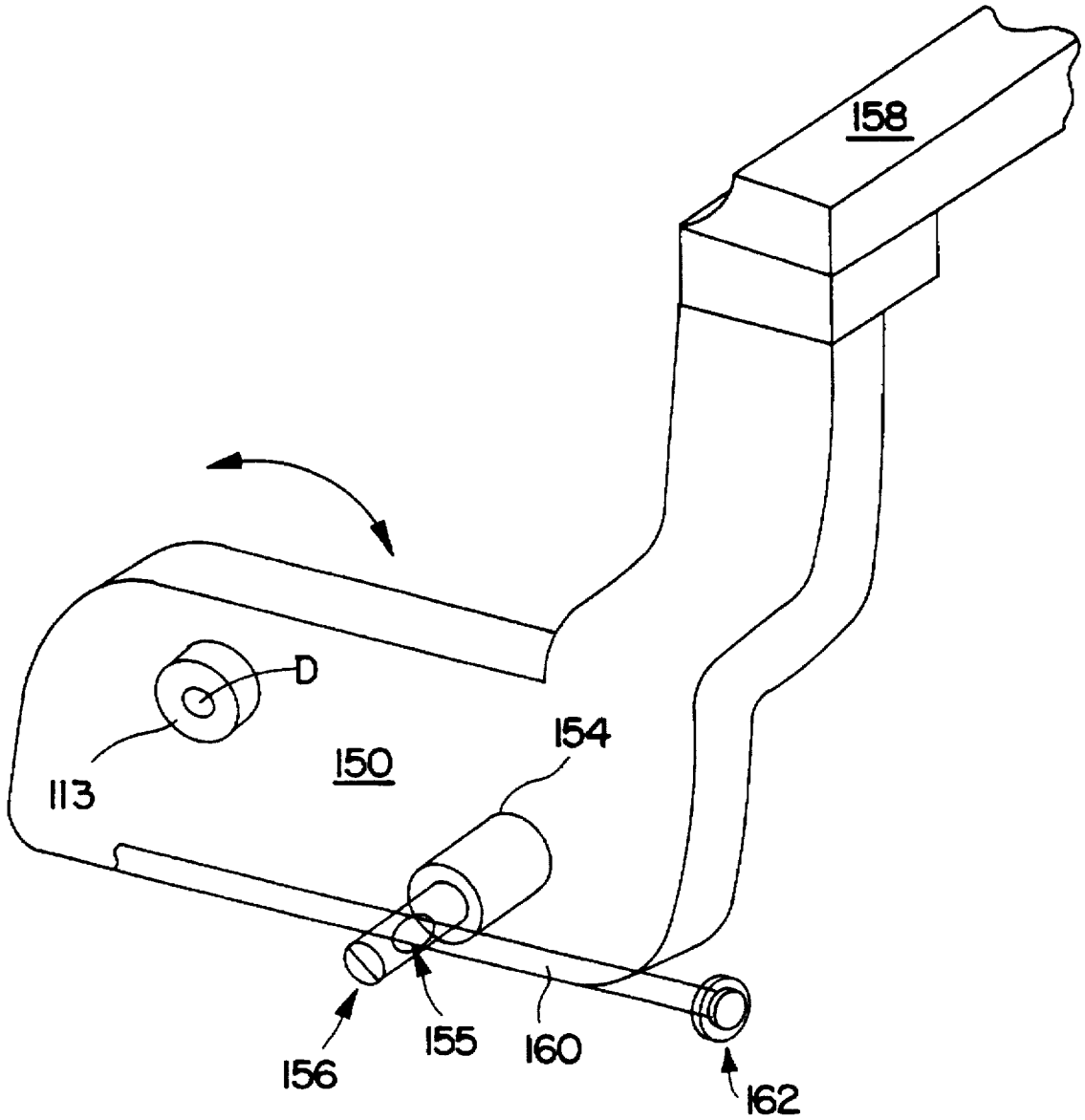
FIG. 7 is an isometric view of the separator carrier and strap separator.

FIG. 7 shows the separator carrier 150 in greater detail where it is seen that pin 113 allows rotation about point D, as indicated by the heavy, arcuate arrow. A projection 154 is of a generally cylindrical shape and includes hole 155. As seen from FIGS. 1, 4, and 6, a spring loaded rod 160 is received therein.

Rod 160 is secured to projection 154 through set-screw 156. As best seen from FIGS. 1, 4, or 6, it is seen that respective springs $165_A$, and $165_B$ are concentric to rod 160, although they are not shown in FIG. 7. This figure illustrates that one rod end is fitted with nuts and washers 162 in order to keep spring $165_B$ retained thereon. The other rod end is attached by typical means to an extension plate 164 on strap chute support bracket 50, as best seen in FIGS. 1, 4 and 6.

Each of the rod springs 165 are of the type which want to keep the obstruction assembly components continuously closed until acted upon by the lever actuating assembly. It is important to note that the spring-loaded rod, being connected to strap separator carrier 150, is horizontally displaced in the direction the handle 12 is moved, when the handle is pulled. This causes the strap separator carrier 150 to pivot clockwise about point D thereby causing the strap separator 158 to pull away from strap chute 175 at the same moment anvil member 90 and support bracket 50 displace, as illustrated in FIG. 5.

Operationally, the lever actuating assembly also has a second detent position, which will now be described. Turning attention to FIG. 6, it is seen that lever 10 is now vertically displaced lower than that of FIG. 4. Plate 16 now has side surface 19 in contact against top surface 62 of cut-off lever 60. No further swinging motion is imputed to members 50, 90, or 150 when in the second detent position. However, the inwardly-directed, horizontal movement of roller bearing 69 against platen surface 120 causes the cutter 130 to reach a fully vertical or upright position, wherein the pivoting action of actuator plate 100 about point C causes the upward projection of cutter 130 towards the strap. The top, razor-like edge 134 servers the strap, and it is automatically rewound onto its supply spool, as is described in one of the related inventions mentioned at the start of this disclosure. Although the end view of FIG. 6 does not clearly show, it should be understood by viewing the schematic of FIG. 5, that the strap separator 158 is attached to the top of the strap separator carrier 150, and that the cutter traverses the strap separator 158 approximately at the point thereon corresponding to a position of the arrowed line designated at $F_2$. The remainder of the strap chute is open (since detent position 1), and now that the strap is severed, the internals of the strapping machine 5 are easily reached.

Closing of the anvil member, strap chute, support bracket and strap separator are easily accomplished by reversing the direction of the handle 12, to the fully closed position shown in FIG. 1.

We claim:

1. An obstruction removing apparatus for a strapping machine having a vertical and horizontal axis and a strap chute extending through said apparatus, said strap chute having an inboard and an outboard side and containing a strap therein for wrapping about a package, said apparatus including a central portion, wherein said strap is severed and sealed about said package, said apparatus comprising:

a frame disposed below said strap chute;

a strap chute support bracket attached to said frame for supporting said chute;

an anvil member received within and pivotally connected to said strap chute support bracket;

a main axle disposed in a generally parallel direction to said strap chute on said outboard side thereof, said main axle interconnecting said anvil member and said strap chute support bracket, said connection allowing pivotable rotation thereabout;

an actuation plate having a top end and a base end with a platen surface projecting therefrom, said actuation plate rotatably pinned to said frame at said base end;

a strap separator carrier disposed on said inboard side of said strap chute and pivotally connected to said top end of said actuation plate;

a lever actuating assembly, said assembly comprised of a plate pivotably attached to said frame, an actuating lever arm attached to said plate, and a cut-off lever rotatably coupled to said plate in obedience to pivotal movement of said plate, said plate having a side surface, said cut-off lever comprised of a horizontal portion having a top surface and a vertical portion having a top end, said cut-off lever having a generally L-shaped configuration wherein said cut-off lever is pivotably pinned to a rear axle where said portions join, said rear axle extending between said frame in a generally parallel direction to said strap chute on said inboard side thereof, said top end of said vertical portion having a roller bearing attached thereto, said roller bearing in confronting relationship to said platen surface of said actuation plate when said assembly is in a first detent position, said first detent position representing a closed and operable condition of said strapping machine, wherein said roller bearing is contacting said platen surface when said lever actuating assembly is in a second detent position, said second position representing an open and locked-out servicing condition of said strapping machine.

2. The apparatus of claim 1, wherein said anvil member, strap chute support bracket and strap separator are respectfully pivoted away from said strap chute when said actuating lever is pulled into said second detent position.

3. The apparatus of claim 2, wherein said strap chute is open when in said second detent position.

4. The apparatus of claim 3, wherein said cut-off lever pivots when said actuating lever is pulled, thereby causing said roller bearing to contact said platen surface.

5. The apparatus of claim 4, wherein said actuating lever is pulled so that a side surface on said plate rests upon a top surface of said horizontal portion of said cut-off lever, whereby said platen surface is rotated towards said strap chute, thereby causing said actuator plate to rotate.

6. The apparatus of claim 5 further including a cutter attached to said actuator plate, said cutter rotating with said actuator plate and being positioned such that said cutter severs said strap within said chute upon rotation.

* * * * *